US005370223A

United States Patent [19]

Leicht, Jr.

[11] Patent Number: 5,370,223

[45] Date of Patent: Dec. 6, 1994

[54] COLLECTIBLE PROTECTOR WITH INTEGRAL CARDHOLDER

[76] Inventor: Russell W. Leicht, Jr., Rte. 3, Box 1208, Asheville, N.C. 28806

[21] Appl. No.: 141,345

[22] Filed: Oct. 22, 1993

[51] Int. Cl.[5] ..... B65D 77/28

[52] U.S. Cl. ..... 206/232; 40/312; 229/162

[58] Field of Search ..... 206/45.31, 45.34, 232; 40/312; 229/162

[56] References Cited

U.S. PATENT DOCUMENTS

| | | | |
|---|---|---|---|
| 3,112,966 | 12/1963 | Reid | 40/312 |
| 3,466,774 | 9/1969 | Borresen | 206/232 |
| 4,047,633 | 9/1977 | Trombly | 40/312 |
| 4,413,730 | 11/1983 | Morse | 206/232 |
| 4,756,409 | 7/1988 | Murray | 40/312 |
| 4,846,775 | 7/1989 | Herrin . | |
| 4,858,756 | 8/1989 | Herrin et al. . | |
| 4,905,828 | 3/1990 | Dods . | |
| 5,040,671 | 8/1991 | Hager . | |
| 5,060,814 | 10/1991 | Oglesbee | 206/45.34 |
| 5,069,334 | 12/1991 | Herrin et al. | 206/45.31 |
| 5,117,972 | 6/1992 | Herrin et al. | 206/45.31 |
| 5,165,538 | 11/1992 | Peters . | |
| 5,168,988 | 12/1992 | Johnnston | 206/45.34 |
| 5,207,717 | 5/1993 | Manning | 206/232 |
| 5,251,745 | 10/1993 | Repp et al. | 206/232 |

FOREIGN PATENT DOCUMENTS

| | | | |
|---|---|---|---|
| 0228993 | 9/1959 | Australia | 206/45.34 |

*Primary Examiner*—Jimmy G. Foster
*Attorney, Agent, or Firm*—Carter & Schnedler

[57] ABSTRACT

A collectible protector for a collectible item such as a 1/64 scale model racing vehicle and a collectible trading card such as a trading card having information printed thereon relating to a driver of the vehicle. The collectible protector includes a container for the vehicle made of transparent plastic sheet material, and a cardholder made of the same material and attached to the container. The container and cardholder may be made of a single folded sheet of the sheet material. The collectible protector is suitable for sale either as packaging for an included collectible item and included collectible trading card, or as an article in and of itself for use by collectors in preserving and protecting an existing collection. In one form, a packaged product combination includes the collectible protector with a contained collectible item and a contained trading card, all in turn packaged within a blister pack.

20 Claims, 6 Drawing Sheets

COLLECTIBLE PROTECTOR WITH INTEGRAL CARDHOLDER

BACKGROUND OF THE INVENTION

The invention relates generally to collectible items and collectible trading cards, such as miniature model vehicles and collectible trading cards relating to drivers of the vehicles. The invention more particularly relates to packaging for such collectible items and collectible trading cards suitable both for use by an individual to display and protect an existing collection, and for use in a display environment for retail sale. As employed herein, the terms "trading card" and "collectible trading card" are intended to refer broadly to any such card-like object having information printed on either or both sides, whether it is in fact used for collection and trading purposes, merely collected, or otherwise.

A variety of miniature collectible items, such as 1/64 scale die-cast model racing vehicles are collected by individuals and are marketed in various forms. In some cases such collectible model racing vehicles are sold in combination with an associated trading card having information printed thereon relating to a driver of the particular vehicle. Such collectible items are generally considered more valuable when they can be preserved in an as-new state, optimally in an unopened package. At the same time, for a collector to enjoy a collection, it should be possible to readily view the items.

One type of prior art package is a clear plastic box made of rigid polyvinyl chloride, and measuring approximately 1-3/16 inches in width by 15/16 inch high by 3½ inches in length. Such boxes include a generally rectangular receptacle having a bottom and four upright sides, and a generally rectangular cover having a top and four depending sides. The receptacle is telescopically received in the cover when the box is closed. Such boxes, however, have no provision for preserving or displaying an associated trading card. Boxes generally constructed along these lines are disclosed in Herrin et al U.S. Pat. Nos. 4,858,756, 5,069,334 and 5,117,972.

An alternative approach, such as is disclosed for example in Dods U.S. Pat. No. 4,905,828, is to employ a blister pack containing a replica vehicle, a stand for the vehicle, and a trading card. The display stand is sized for supporting the replica vehicle and, in addition, includes a groove for receiving the trading card for display immediately behind the vehicle. While such a package is attractive for retail display purposes, there are disadvantages from the standpoint of the ultimate consumer who purchases for the purpose of collection. In particular, once the blister pack is opened, there is essentially no protection for either the model vehicle or the trading card, and the value as a collectible item is substantially impaired.

SUMMARY OF THE INVENTION

Accordingly, it is an object of the invention to provide a collectible protector which can preserve, protect and display both a collectible item such as a model vehicle and a collectible trading card such as a card having information printed thereon relating to a driver of the vehicle.

It is yet another object of the invention to provide such a collectible protector which is suitable for retail display and sale purposes, as well as for sale as an article itself to individual collectors for repackaging an existing collection.

It is yet another object of the invention to provide an improved packaged product for retail display and sale purposes.

Briefly, in accordance with the invention a collectible protector includes a container made of transparent plastic substantially rigid self-supporting sheet material, sized for receiving a collectible item such as a model vehicle. In one embodiment, the container is made of a single sheet of the sheet material appropriately folded and glued. In another embodiment, the container includes a generally rectangular receptacle having a bottom and four upright sides, and a generally rectangular cover having a top and four depending sides.

The collectible protector additionally includes a cardholder likewise made of transparent plastic substantially rigid self-supporting sheet material. The cardholder has two facing sections of the sheet material arranged for receiving a collectible trading card, such as a trading card having information printed thereon relating to a driver of the vehicle, sandwiched between the sections. Typically, the two facing sections of the cardholder comprise a single folded sheet of the sheet material. The cardholder is attached to the container so as to provide a unitary structure.

In the preferred embodiment when the container is made of a single folded sheet of the sheet material, the cardholder is also part of this single folded sheet of the sheet material such that the container and the cardholder comprise a single folded sheet of the sheet material. In the case of a container in the form of a generally rectangular receptacle and a generally rectangular cover, the cardholder is attached to the cover, either by gluing, or by being formed as a single sheet integral with the cover.

Preferably, the container is elongated and generally rectangular in configuration, with a pair of endwalls at opposite ends. A spacer tab projects inwardly from each of the endwalls. The spacer tabs are sized for contacting the collectible item to generally longitudinally center the item within the container and to prevent end-to-end movement of the collectible item within the container. Preferably, the container, including the spacer tabs, and the cardholder are all made from a single folded sheet of the sheet material.

The cardholder typically has open ends. Preferably at one end there is a retainer tab folded over the one end so as to prevent movement of the trading card out of the one end. The retainer tab may be integral with one of the facing sections and glued to the other of the facing sections.

In accordance with another embodiment of the invention, there is provided a packaged product combination including a collectible item and a collectible trading card related to the collectible item. The packaged product combination additionally includes a container which contains the collectible item and which is of the form briefly described above; and a cardholder attached to the container, the cardholder likewise of the form briefly described above, and having the collectible trading card sandwiched between the sections of the cardholder. The container and attached cardholder, which respectively enclose the collectible item and the collectible trading card, are enclosed within a blister pack. Thus, there is a blister card against which the container and attached cardholder are disposed, and a clear plastic case attached to the blister card for holding and displaying the container and attached cardholder.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

DETAILED DESCRIPTION

Figure 1:
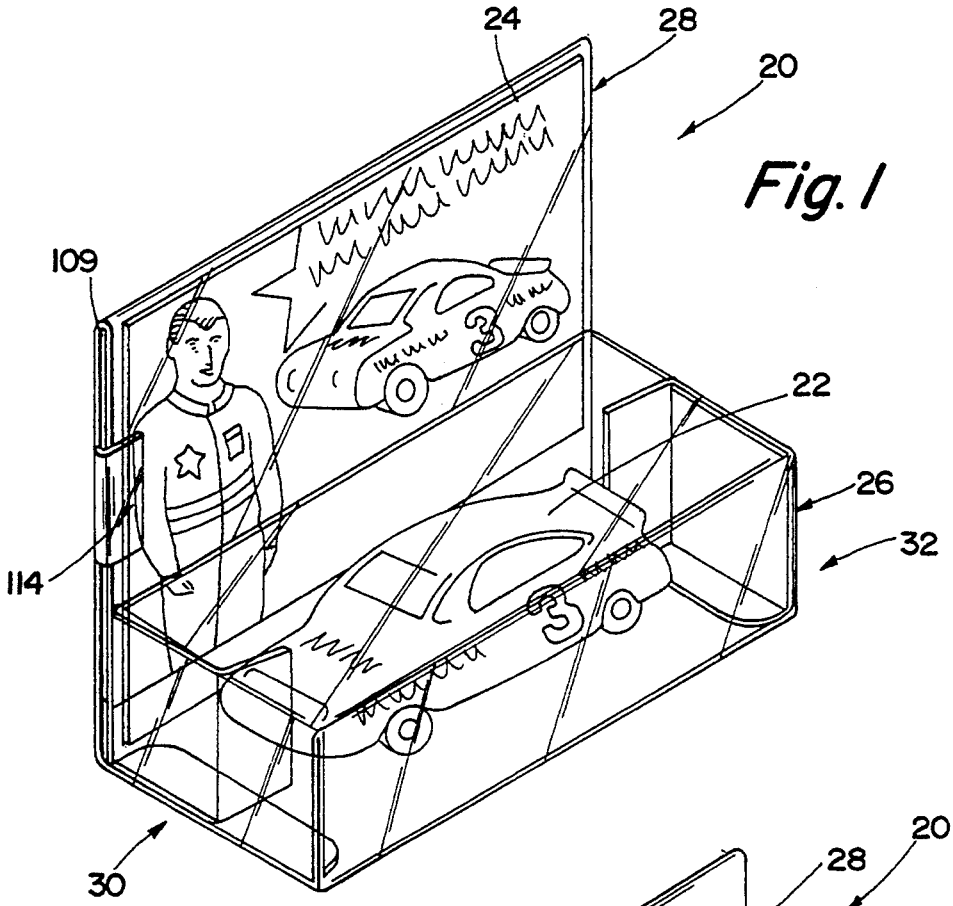
FIG. 1 is a three-dimensional view of a collectible protector in accordance with the invention, containing both a model vehicle and a collectible trading card relating to a driver of the vehicle.

Referring now to the drawings, FIGS. 1-12 are various views of a collectible protector 20 in accordance with a first embodiment of the invention. FIG. 1 shows the collectible protector 20 containing a model vehicle 22 and a trading card 24, while the remaining FIGS. 2-12 depict the collectible protector 20 in various forms generally without the model vehicle 22 and trading card 24; however, in FIGS. 4, 5, 8 and 9, the position of the model vehicle 22 is shown in phantom for clarity of illustration.

The collectible protector 20 includes a container 26 sized for receiving the collectible item 22 in the illustrative form of a model vehicle, and additionally includes a cardholder 28 which is attached to the container 26, and which holds the collectible trading card 24 relating to a driver of the vehicle 22. It is a feature of the invention that the cardholder 28 is attached to the container 26, so as to form a unitary package to protect both the model vehicle 22 and the card 24, while at the same time presenting both for display purposes.

The container 26 is elongated and generally rectangular in configuration, having left and right endwalls at opposite ends, generally designated 30 and 32 respectively. As may be best seen in FIG. 2, at the left end 30 there are an inner closure flap 34, an intermediate closure flap 36, and an outer closure flap 38 including an integral closure tab 40 and having locking notches 42 and 44. Similarly, at the right end 32 there are an inner closure flap 46, an intermediate closure flap 48 and an outer closure flap 50 including an integral closure tab 52 and having locking notches 54 and 56.

The collectible protector 20 is made of transparent polymeric material, such as a sheet of rigid polyvinyl chloride having a high impact resistance and a thickness of about 0.010 inch. Any rigid or semi-rigid plastic material such as polyethylene, polystyrene, or the like, may of course be employed, and decoration or legends (not shown) may be printed on the collectible protector 20 itself.

Figure 2:
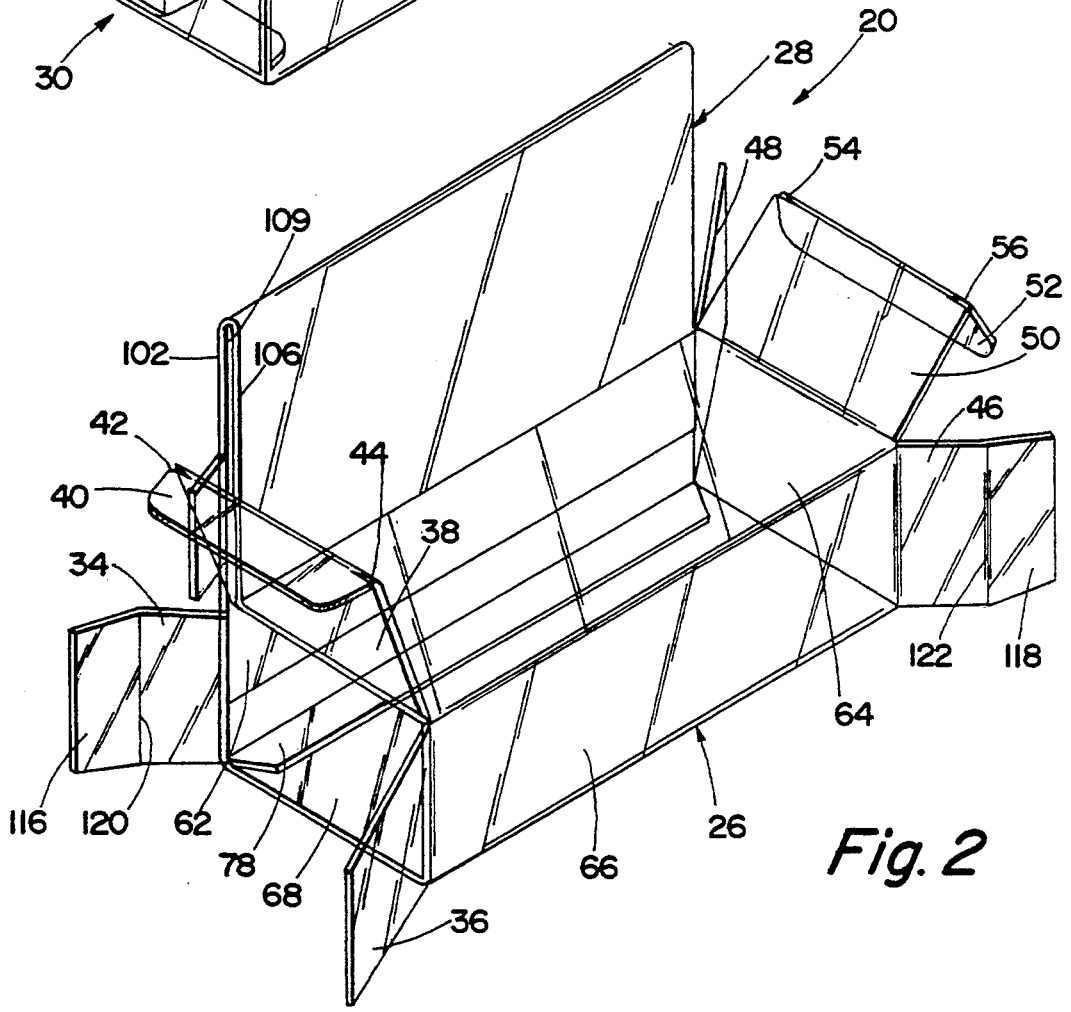
FIG. 2 is a similar three-dimensional view of the collectible protector of FIG. 1, with the ends of the container open in preparation for receiving a model vehicle.
Figure 3:
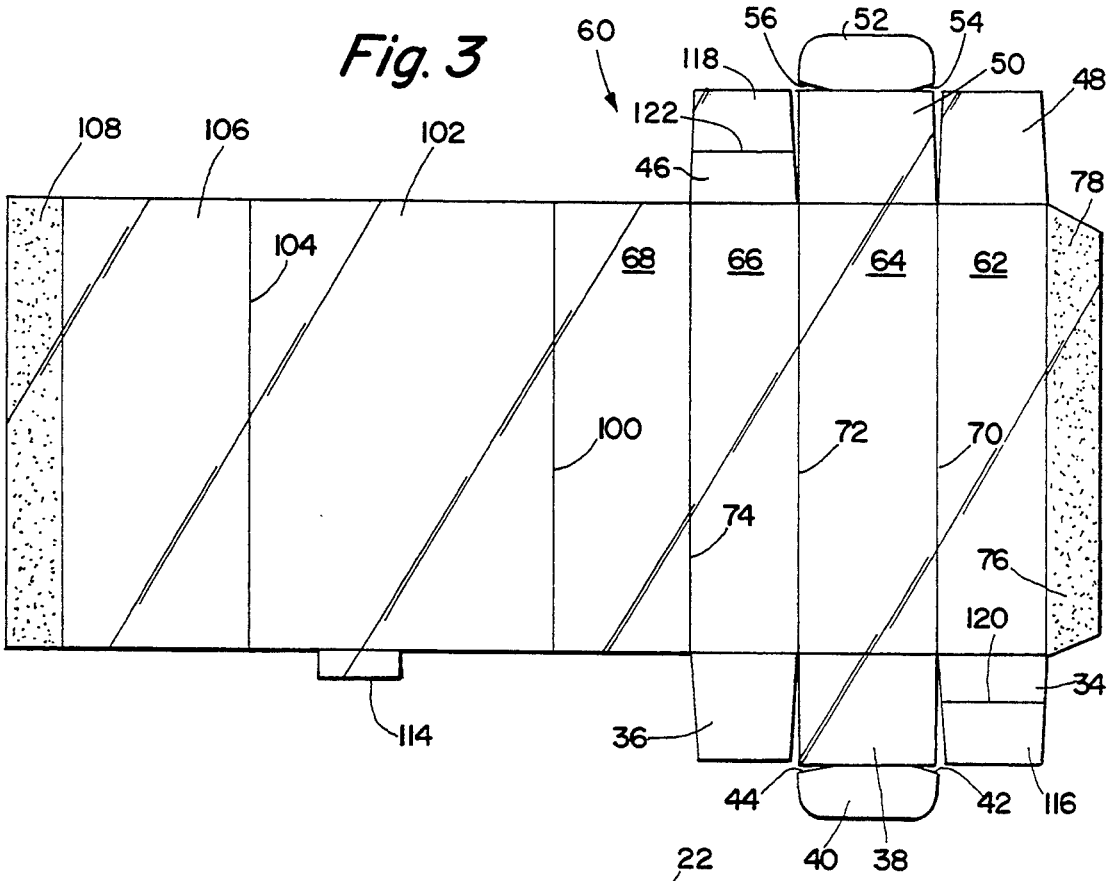
FIG. 3 is a plan view of a blank of transparent plastic material prior to being folded and glued to form the collectible protector of FIGS. 1 and 2.
Figure 4:
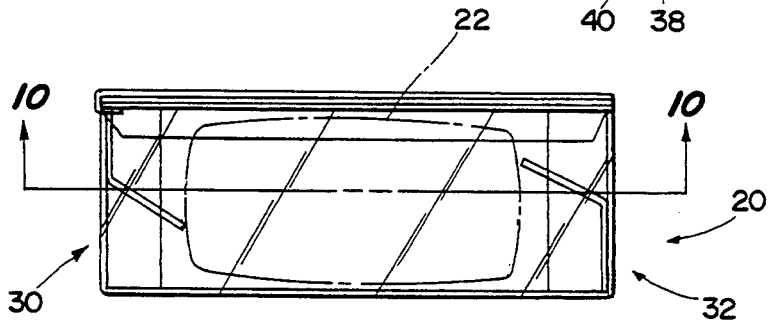
FIG. 4 is a plan view of the collectible protector, with the position of a model vehicle shown in phantom.
Figure 5:
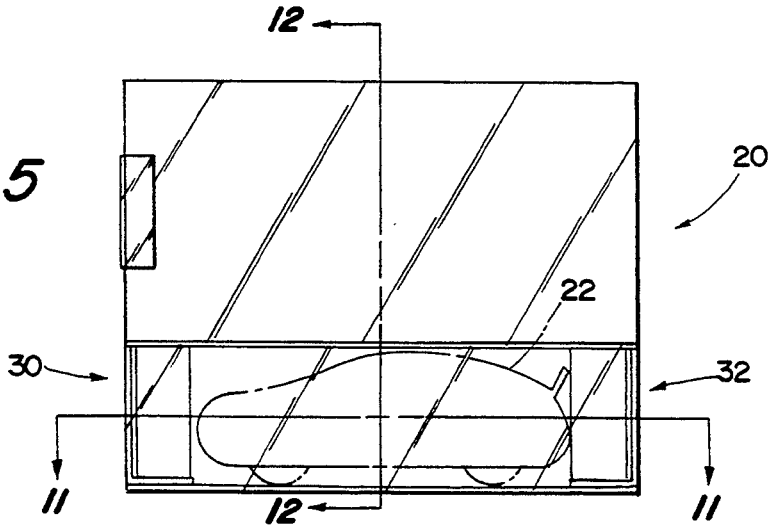
FIG. 5 is a front elevation of the collectible protector, again with the position of a model vehicle shown in phantom.
Figure 6:
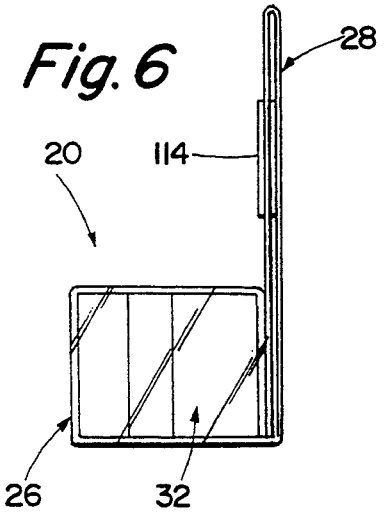
FIG. 6 is a side elevational view from the right side of the collectible protector.
Figure 8:
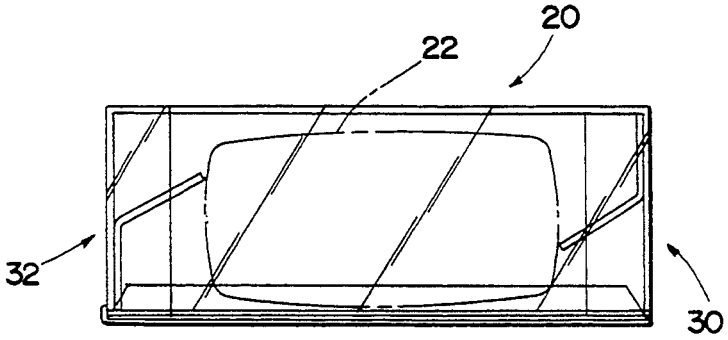
FIG. 8 is a bottom view of the collectible protector.
Figure 9:
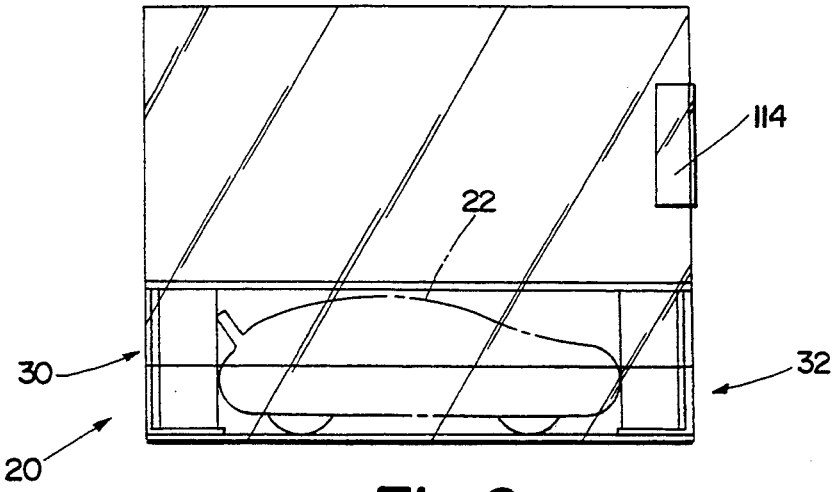
FIG. 9 is a rear elevational view of the collectible protector.
Figure 7:
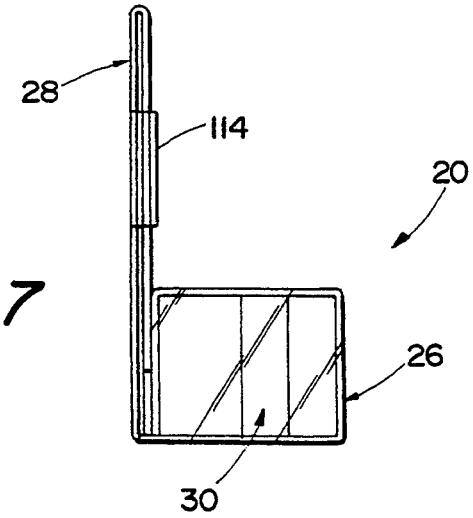
FIG. 7 is a side elevational view from the left side of the collectible protector.
Figure 10:
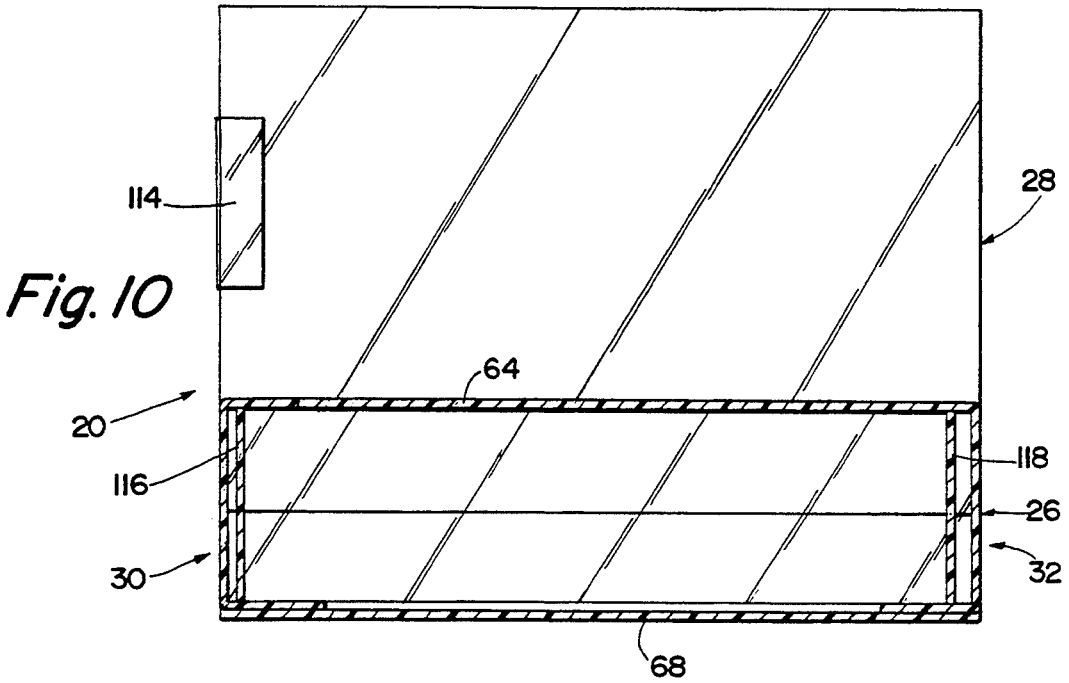
FIG. 10 is a view, partly in section, taken on line 10—10 of FIG. 4.
Figure 11:
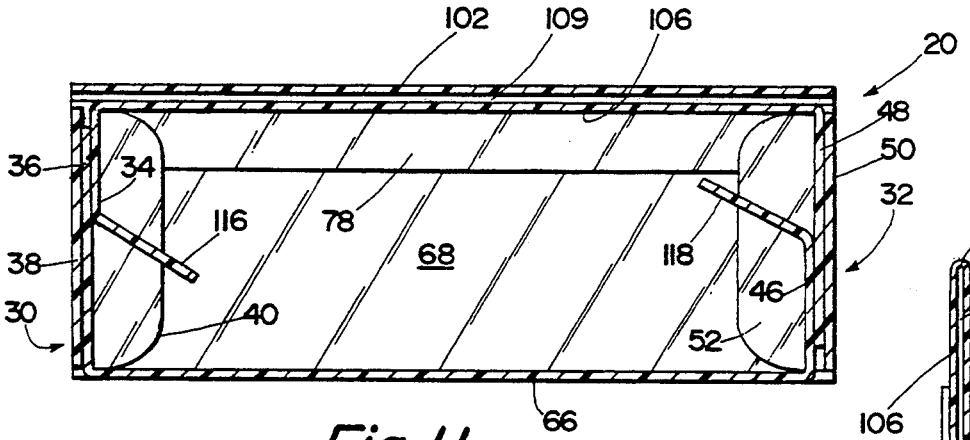
FIG. 11 is a view, partly in section, taken on line 11—11 of FIG. 5.

Preferably, and as will be apparent from FIG. 3, the collectible protector 20, including both the container 26 and the integral cardholder 28, is formed from a single folded blank 60 of the sheet material. Thus, and with reference both to the collectible protector 20 of FIG. 2 and to the blank 60 of FIG. 3, it will be seen that elements of the two figures correspond.

Figure 12:
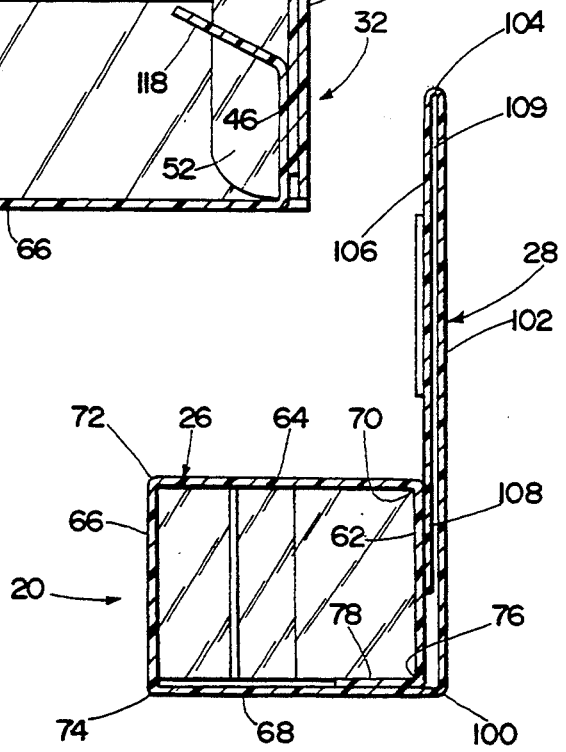
FIG. 12 is a view, partly in section, taken on line 12—12 of FIG. 5.

More particularly, and with reference to FIGS. 2 and 3 as well as to FIG. 12, the container 26 has a back 62, a top 64, a front 66 and a bottom 68. These four elements are joined at fold lines 70, 72 and 74 as indicated in FIG. 3. In addition, attached to the back 62 at a fold line 76 is a glue tab 78 which, upon assembly, is glued to the inside surface of the bottom 68, as is perhaps best seen in FIG. 12. To complete the container 26 portion of the collectible protector 20, the left and right inner closure flaps 34 and 46 are joined at respective fold lines 80 and 82 to the back 62 and front 66, respectively; the left and right intermediate closure flaps 36 and 48 are joined at respective fold lines 84 and 86 to the front 66 and back 62, respectively; and the left and right outer closure flaps 38 and 50 are joined at respective fold lines 88 and 90 to the top 64. The outer closure flaps 38 and 50 are joined to their respective integral closure tabs 40 and 52 at respective fold lines 92 and 94.

Attached to the container bottom 68 at a fold line 100 is a back section 102 of the cardholder 28, which is in turn connected, at a fold line 104, to a front section 106 of the cardholder 28. The cardholder front section 106 has a gluing area 108 which, upon assembly of the collectible protector 20, is glued to the outside surface of the container back 62, also as is illustrated in FIG. 12.

A suitable transparent adhesive is employed for assembly. Alternatively, depending upon the particular material, the adhered sections may be joined by fusing upon the application of suitable temperature and pressure. Thus, the term "glued" as employed herein is intended to be read broadly.

The resultant cardholder 28 has a pocket-like space 109 between the sections 102 and 106 and has open ends 110 and 112, through which the card 24 may be inserted into the space 109 such that the card 24 is sandwiched between the cardholder front and back sections 106 and 102. In order to prevent movement of the collectible trading card 24 out of the space 109 through at least one of the ends 110 and 112, for example through the end 110, a retainer tab 114 is provided, which is folded over the open end 110, as may be seen in FIG. 1. Preferably, the retainer tab 114 is integral with one of the sections 102 and 106. In the illustrated embodiment the retainer tab is integral with the back section 102, and is glued to the other of the facing sections, in this example to the front of the front section 106.

As another feature of the invention, the container 26 includes respective left and right side spacer tabs 116 and 118 which project inwardly generally from the endwalls 30 and 32. The spacer tabs 116 and 118 are sized for contacting the collectible item 22 in the illustrative form of a model vehicle, as may be seen in FIGS. 1, 4, 5, 8 and 9. The spacer tabs 116 and 118 serve to generally longitudinally center the model vehicle 22 within the container 26, and additionally serve to prevent end-to-end movement of the model vehicle 22 within the container 26.

More particularly, in the illustrated embodiment, the left and right side spacer tabs 116 and 118 are respectively attached to the inner closure flaps 34 and 46 at respective fold lines 120 and 122. Thus, the spacer tabs 116 and 118 are formed from the single folded blank 60 of the sheet material, as will be apparent from FIG. 3.

It will be appreciated that the collectible protector 20 of FIGS. 1–12 is suitable as an article to be sold, complete with a model vehicle 22 and an associated trading card 24. The collectible protector 20 is additionally suitable for sale as an empty container either to individual collectors wishing to better preserve and protect an existing collection while facilitating display, or to dealers who may wish to package various collectible items for sale.

Figure 13:
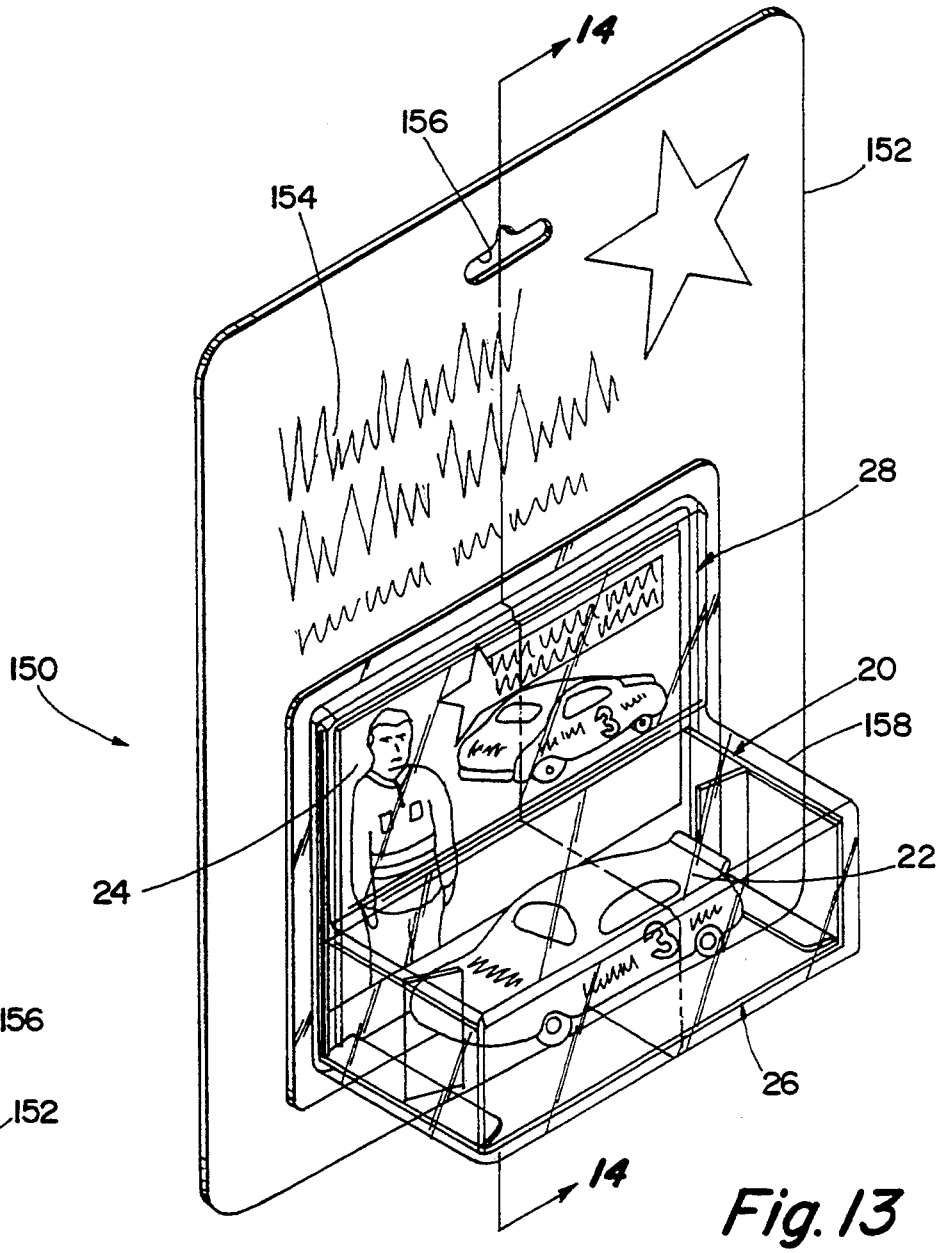
FIG. 13 is a three-dimensional view of a packaged product combination, including the collectible protector of FIG. 1, containing a model vehicle and a collectible trading card, all within a blister pack.
Figure 14:
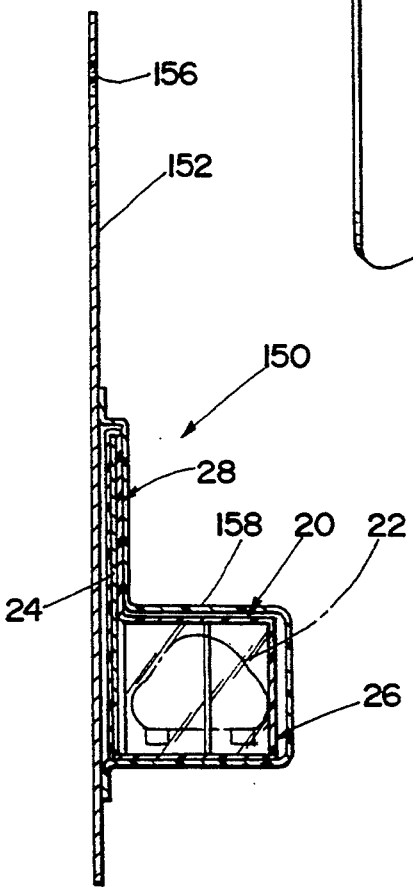
FIG. 14 is a section taken on line 14—14 of FIG. 13.

FIGS. 13 and 14 depict another embodiment of the invention wherein the collectible protector 20, complete with the collectible article 22 and the collectible trading card 24, as illustrated in FIG. 1, is in turn entirely contained within a blister pack, to produce a packaged product combination, generally designated 150. Thus, the packaged product combination 150 includes a blister card 152 having indicia 154 printed thereon, and an optional cutout 156 for hanging on a display rack. The container 26 and attached cardholder 28, including the packaged items 22 and 24, are disposed against the blister card 152, and a clear plastic case 158 comprising a blister pack 158 is attached to the blister card 152 in a conventional manner for holding and displaying the container 26 and attached cardholder 28, as well as the contained model vehicle 22 and collectible trading card 24.

It will be appreciated that the packaged product combination 150 advantageously combines an attractive point of sale display with a product which, in effect, need be only partially opened, thus preserving the collectible value of the model vehicle 22 and the trading card 24. An ultimate consumer who purchases the packaged product combination 150 can cut open the blister pack 158, without necessarily opening the container 26.

Figure 15:
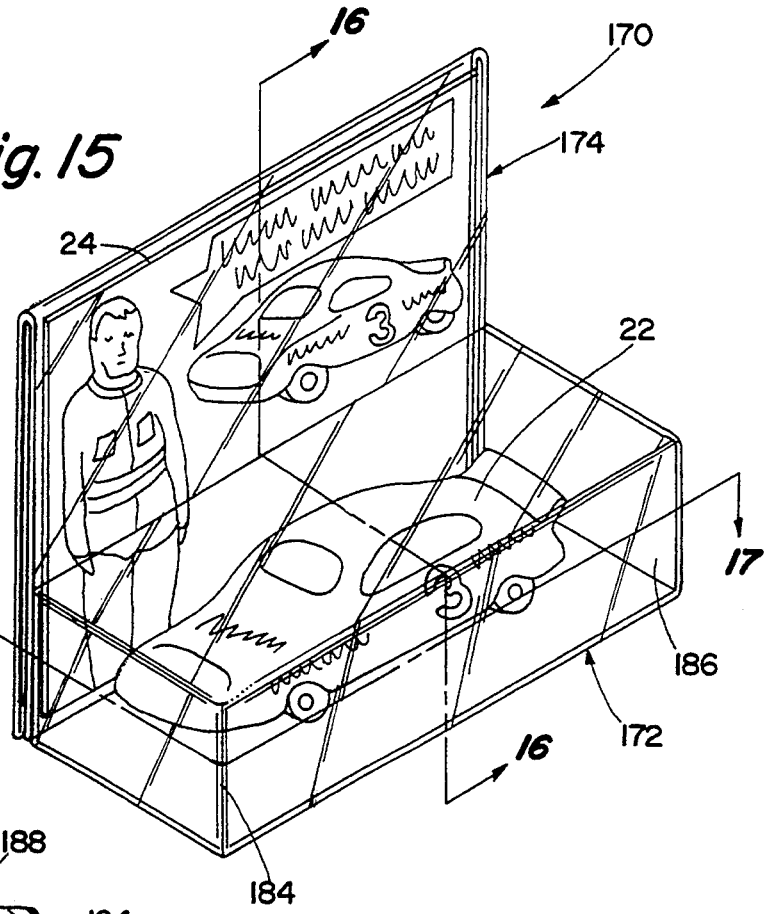
FIG. 15 is a three-dimensional view of an alternative embodiment of the invention wherein the container portion of a collectible protector includes a receptacle with a separate cover.
Figure 16:
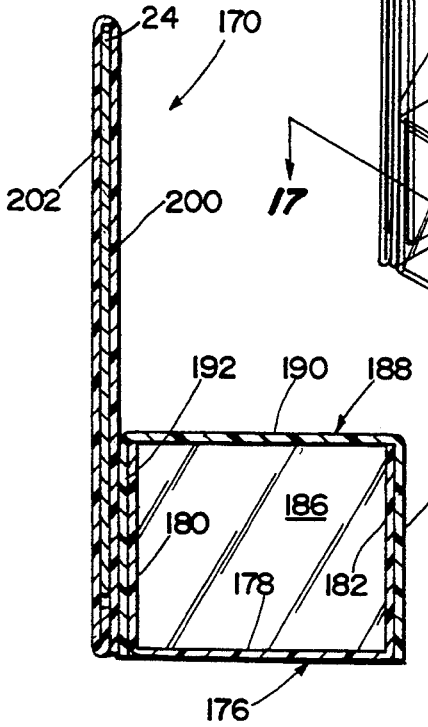
FIG. 16 is a section taken on line 16—16 of FIG. 15.
Figure 17:
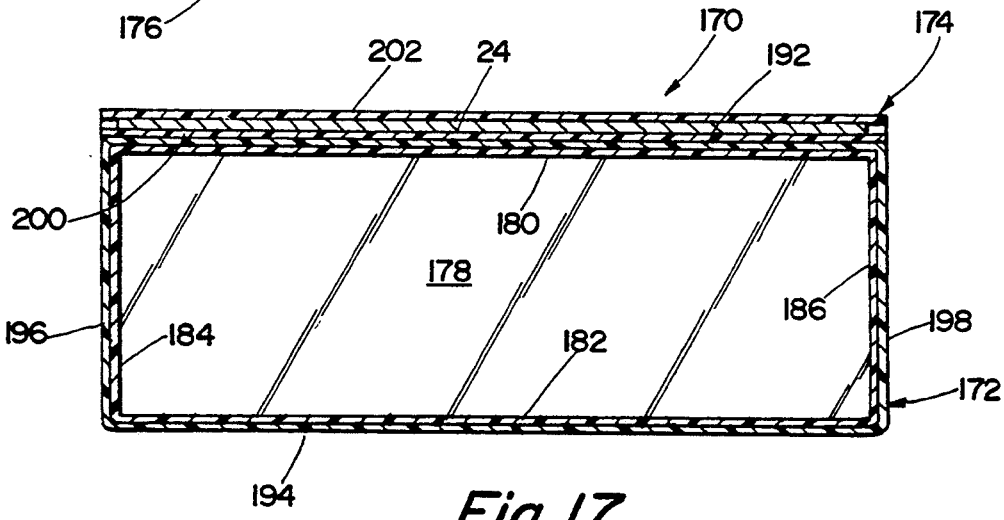
FIG. 17 is a section taken on line 17—17 of FIG. 15.

Referring finally to FIGS. 15, 16 and 17, illustrated is another embodiment of a collectible protector 170, which is an alternative to the collectible protector 20 of FIGS. 1–12.

The collectible protector 170 includes a container 172 for receiving the model racing vehicle 22, and an attached cardholder 174 for receiving the collectible trading card 24, both in generally the same manner as described hereinabove with reference to the collectible protector 20 of FIGS. 1–12.

The container 172 differs from the container 26 in that the container 172 is not formed from a single sheet of transparent plastic material. Rather, the container 172 has a generally rectangular receptacle 176 having a bottom 178 and four upright sides 180, 182, 184 and 186; and a separate generally rectangular cover 188 having a top 190 and four depending sides 192, 194, 196 and 198.

The cardholder 174 is attached to the cover 188, either by gluing, or by being an integral part of the cover 188, folded from the same sheet of transparent plastic sheet material, and having two facing sections 200 and 202.

In view of the foregoing, it will be appreciated that the invention advantageously provides a collectible protector suitable for use either as an item in and of itself, or in conjunction with the retail sale of collectible items and related collectible trading cards.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A collectible protector comprising:

a container in the shape of a rectangular parallelepiped having six rectangular faces and comprising transparent plastic substantially rigid self-supporting sheet material, said container being sized for receiving a collectible item; and a rectangular cardholder comprising transparent plastic substantially rigid self-supporting sheet material, said cardholder having two facing sections of its sheet material arranged for receiving a collectible trading card sandwiched between said sections;

said cardholder being attached to one of the faces of said container in parallel adjacent relationship, said cardholder having a greater extent than said one of the faces and relatively positioned such that a lowermost edge of said cardholder coincides with one edge of said one of the faces, said cardholder extends past an opposite edge of said one of the faces to an uppermost edge of said cardholder, and side edges of said cardholder are in alignment with corresponding edges of said one of the faces.

2. A collectible protector in accordance with claim 1, wherein said two facing sections of said cardholder comprise a single folded sheet of the sheet material.

3. A collectible protector in accordance with claim 1, wherein said container and said cardholder comprise a single folded sheet of the sheet material.

4. A collectible protector in accordance with claim 1, wherein said container comprises a generally rectangular receptacle having a bottom and four upright sides and a generally rectangular cover having a top and four depending sides; and wherein said cardholder is attached to said cover.

5. A collectible protector in accordance with claim 4, wherein said two facing sections of said cardholder comprise a single folded sheet of the sheet material.

6. A collectible protector in accordance with claim 1 wherein said container is sized for receiving a model vehicle and said cardholder is sized for receiving a card having information printed thereon relating to a driver of the vehicle.

7. A collectible protector in accordance with claim 1, wherein said cardholder has open ends, and includes at one end a retainer tab folded over the one end so as to prevent movement of the collectible trading card out of the one end.

8. A collectible protector comprising:

a container comprising transparent plastic substantially rigid self-supporting sheet material, said container being sized for receiving a collectible item; and a cardholder comprising transparent plastic substantially rigid self-supporting sheet material, said cardholder having two facing sections of its sheet material arranged for receiving a collectible trading card sandwiched between said sections;

said cardholder being attached to said container;

said container being elongated and generally rectangular in configuration, having a pair of endwalls at opposite ends; and said container including a spacer tab projecting inwardly from each of the endwalls, said spacer tabs being sized for contacting the collectible item to generally longitudinally center the item within said container and to prevent end-to-end movement of the collectible item within the container.

9. A collectible protector in accordance with claim 8, wherein said container, including said spacer tabs, and said cardholder comprise a single folded sheet of the sheet material.

10. A collectible protector comprising:

a container comprising transparent plastic substantially rigid self-supporting sheet material, said container being sized for receiving a collectible item; and a cardholder comprising transparent plastic substantially rigid self-supporting sheet material, said cardholder having two facing sections of its sheet material arranged for receiving a collectible trading card sandwiched between said sections;

said cardholder being attached to said container;

said cardholder having open ends, and including at one end a retainer tab folded over the one end so as to prevent movement of the collectible trading card out of the one end; and said retainer tab being integral with one of said facing sections and being glued to the other of said facing sections.

11. A packaged product combination comprising:

a collectible item;

a collectible trading card related to said collectible item;

a container containing said collectible item, said container comprising transparent plastic substantially rigid self-supporting sheet material;

a cardholder attached to said container, said cardholder comprising transparent plastic substantially rigid self-supporting sheet material, said cardholder having two facing sections of its sheet material, with said collectible trading card sandwiched between said sections;

a blister card, said container and attached cardholder which respectively enclose said collectible item and said collectible trading card being disposed against said blister card; and a clear plastic case comprising a blister pack attached to said blister card for holding and displaying said container and attached cardholder.

12. A packaged product combination in accordance with claim 11, wherein said two facing sections of said cardholder comprise a single folded sheet of the sheet material.

13. A packaged product combination in accordance with claim 11, wherein said container and said cardholder comprise a single folded sheet of the sheet material.

14. A packaged product combination in accordance with claim 11, wherein said container comprises a generally rectangular receptacle having a bottom and four upright sides and a generally rectangular cover having a top and four depending sides; and wherein said cardholder is attached to said cover.

15. A packaged product combination in accordance with claim 14, wherein said two facing sections of said cardholder comprise a single folded sheet of the sheet material.

16. A packaged product combination in accordance with claim 11, wherein said collectible item comprises a model vehicle and said collectible trading card has information printed thereon relating to a driver of the vehicle.

17. A packaged product combination in accordance with claim 11, wherein said container is elongated and generally rectangular in configuration, having a pair of endwalls at opposite ends; and wherein said container includes a spacer tab projecting inwardly from each of the endwalls, said spacer tabs being sized for contacting the collectible item to generally longitudinally center the item within said container and to prevent end-to-end movement of the collectible item within the container.

18. A packaged product combination in accordance with claim 17, wherein said container, including said spacer tabs, and said cardholder comprise a single folded sheet of the sheet material.

19. A packaged product combination in accordance with claim 11, wherein said cardholder has open ends, and includes at one end a retainer tab folded over the one end so as to prevent movement of the collectible trading card out of the one end.

20. A packaged product combination in accordance with claim 19, wherein said retainer tab is integral with one of said facing sections and is glued to the other of said facing sections.

* * * * *